US012495943B1

(12) United States Patent
Roe

(10) Patent No.: US 12,495,943 B1
(45) Date of Patent: Dec. 16, 2025

(54) MOPPING SYSTEM ATTACHMENT MECHANISM

(71) Applicant: Contec, Inc., Spartanburg, SC (US)

(72) Inventor: Preston Roe, Lyman, SC (US)

(73) Assignee: CONTEC, INC., Spartanburg, SC (US)

( * ) Notice: Subject to any disclaimer, the term of this patent is extended or adjusted under 35 U.S.C. 154(b) by 573 days.

(21) Appl. No.: 17/968,324

(22) Filed: Oct. 18, 2022

Related U.S. Application Data

(60) Provisional application No. 63/256,809, filed on Oct. 18, 2021.

(51) Int. Cl.
*A47L 13/254* (2006.01)
*A47L 13/42* (2006.01)

(52) U.S. Cl.
CPC ..... *A47L 13/254* (2013.01); *A47L 13/42* (2013.01)

(58) Field of Classification Search
CPC ..... A47L 13/254; A47L 13/42; A47L 13/24; A47L 13/257; A47L 13/258
USPC ..... 15/143.1, 228
See application file for complete search history.

(56) References Cited

U.S. PATENT DOCUMENTS 2,204,486 A * 6/1940 George ..... B24B 23/04 451/519
4,225,998 A * 10/1980 Thielen ..... A47L 13/256 451/517
7,178,189 B1 * 2/2007 Perry ..... A47L 13/144 15/147.1

* cited by examiner

*Primary Examiner* — Brian D Keller
*Assistant Examiner* — Jason Khalil Hawkins
(74) *Attorney, Agent, or Firm* — J.M. Robertson LLC

(57) ABSTRACT

A mop tool incorporating an attachment frame which can be pressed into place in locking relation across a disposable mop head backer plate. The attachment mechanism is releasable following use by a suitable technique such that the mop head can thereby be disengaged from the attachment frame without any need for the user to touch the mop head. The attachment frame may be pressed against a raised or depressed center zone on the backer plate thereby causing camming arms to rotate and moving operatively connected outboard rail members to a locked position. When detachment is desired, the prior rotation may be reversed thereby releasing the rail members such that the mop head can fall away.

6 Claims, 4 Drawing Sheets

MOPPING SYSTEM ATTACHMENT MECHANISM

CROSS-REFERENCE TO RELATED APPLICATION(S)

This non-provisional application claims the benefit of, and priority from, U.S. provisional application 63/256,809 having a filing date of 18 Oct. 2021. The contents of such prior application and all other documents referenced herein are hereby incorporated by reference herein as if fully set forth in their entirety.

TECHNICAL FIELD

The present disclosure relates generally to cleaning products, and more particularly to a mechanism adapted to releasably secure an attachment frame to a mop head backer plate. The mechanism may have particular application in securing a handle-supported attachment frame to a backer plate of the type illustrated and described in U.S. Pat. Nos. 7,882,589 and D566,916 the contents of all of which are incorporated by reference in their entirety.

BACKGROUND

U.S. Pat. No. 7,882,589, which is commonly owned with the instant application, discloses a mop system incorporating a contoured mop head adapted for snap-on, pressure fit attachment to an attachment frame having a pair of substantially planar free end portions. While such a snap-on attachment mechanism is highly effective, the design may require a person to use their hands to disengage the frame from the mop head after use. Some people may find this disengagement difficult to carry out. Additionally protective gloves may be required to touch the mop head during removal depending on the nature of the cleaning operation. Moreover, minimizing contact with the mop head provides the benefit of reducing the potential for cross-contamination between locations in critical environments. Eliminating the need to touch the mop head for disposal avoids the potential that a user may inadvertently transmit contamination from one location to another as multiple mop heads are used. Accordingly, a releasable attachment mechanism permitting hands-free disengagement of the frame from the mop head represents a useful advancement over the current art.

SUMMARY

The present disclosure offers advantages and alternatives over the prior art by providing a mop tool incorporating an attachment frame which can be pressed into place in locking relation across a mop head backer plate such as those illustrated and described in U.S. Pat. Nos. D566,916 and 7,882,589. However, other mop head constructions may also be used if desired. The attachment mechanism is releasable following use by a suitable technique such as activating a release lever, overcoming a biasing spring, or other locking release systems. The release may be carried out using a tension wire, a cable, a wired or wireless signal or other suitable transmission arrangement that can be activated by a user from the handle. The mop head can thereby be disengaged from the attachment frame without any need for the user to touch the mop head.

In accordance with one exemplary aspect, the attachment frame may include a pair of articulating inboard arms operatively connected to outboard rail members such that rotation of the inboard arms is translated to the outboard rail members. The attachment frame may be pressed against a raised or depressed center zone on the backer plate thereby causing the arms to rotate inwardly in a camming action and pressing the rail members under outwardly projecting lips on raised surface elements such that the frame is held in place. A spring-loaded locking bar may be used to aid in holding the rail members in place and maintaining secure engagement between the attachment frame and the backer plate during use. When detachment is desired, a lever arm or other suitable mechanism is used to apply downward spreading force against the inboard arms thereby reversing the prior rotation and releasing the rail members from capture such that the mop head can fall away. A tensioning cable operatively connected to a user activated lever remote from the attachment frame may be particularly preferred to release the connection and allow the mop head backer plate to fall away from the frame.

Other features and advantages of the disclosure will become apparent to those of skill in the art upon review of the following detailed description, claims and drawings.

Figure 1:
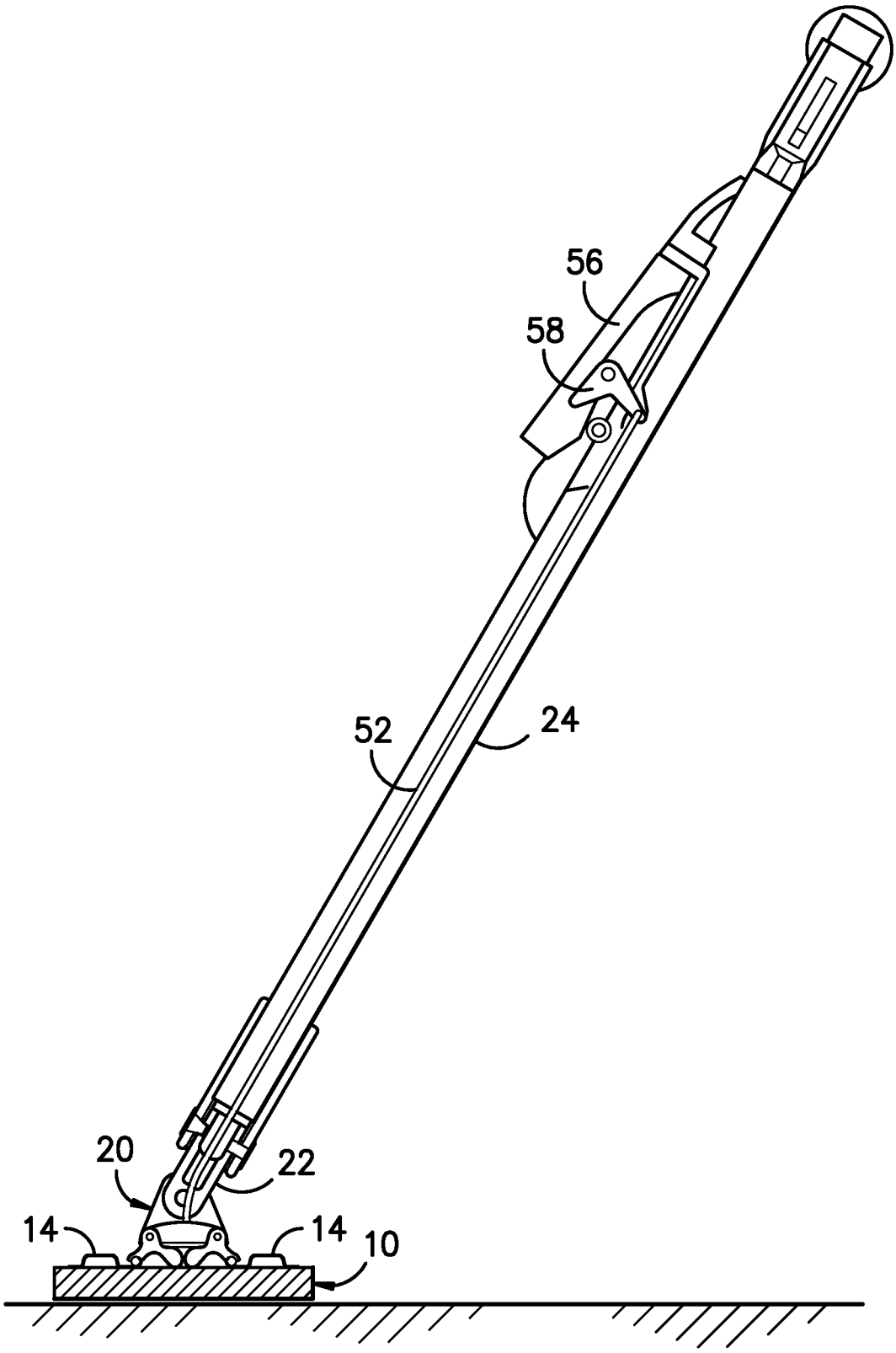
FIG. 1 is a schematic view of an exemplary mop head with a backer plate engaged by an attachment frame in pivoting relation to a user manipulated handle.

Before the exemplary embodiments of the disclosure are explained in detail, it is to be understood that the disclosure is in no way limited in its application or construction to the details and the arrangements of the components set forth in the following description or illustrated in the drawings. Rather, the disclosure is capable of other embodiments and of being practiced or being carried out in various ways. Also, it is to be understood that the phraseology and terminology used herein are for purposes of description only and should not be regarded as limiting. The use herein of terms such as "including" and "comprising", and variations thereof is meant to encompass the items listed thereafter and equivalents thereof as well as additional items and equivalents thereof.

DESCRIPTION

Exemplary embodiments of the disclosure will now be described through reference to the drawings wherein like elements are designated by like reference numerals in the various views. FIG. 1 illustrates an exemplary mop head 10 having a contoured backer plate 12 of relatively light-weight molded plastic or the like. As illustrated, backer plate 12 may include raised surface elements 14 extending at least partially along the length of backer plate 12. Depressed well zones may be disposed between the raised surface elements if desired. By way of example only, and not limitation, backer plate 12 may have a configuration as described in U.S. Pat. Nos. D566,916 and 7,882,589 (all incorporated by reference in their entirety). However, any other configuration with suitable surface contouring may likewise be used.

As shown, an attachment frame 20 (best seen in FIG. 5) may be disposed in swiveling relation to a handle attachment bracket 22 operatively connected to an elongated handle 24. As will be appreciated, a user may apply a downward force through handle 24 to press attachment frame 20 against backer plate 12.

In accordance with one exemplary practice, attachment frame 20 may engage the backer plate 12 in releasable clamping relation by use of an applied downward force from a user. In this regard, in the illustrated exemplary construction, attachment frame 20 includes a base 26 connected with pivots 28 to articulating inboard arms 30. Inboard arms 30 are operatively connected to outboard rail members 32 such that rotation of the inboard arms 30 is translated to the outboard rail members 32. Thus, rotation of inboard arms 30 causes rail members 32 to rotate relative to base 26.

Figure 3:
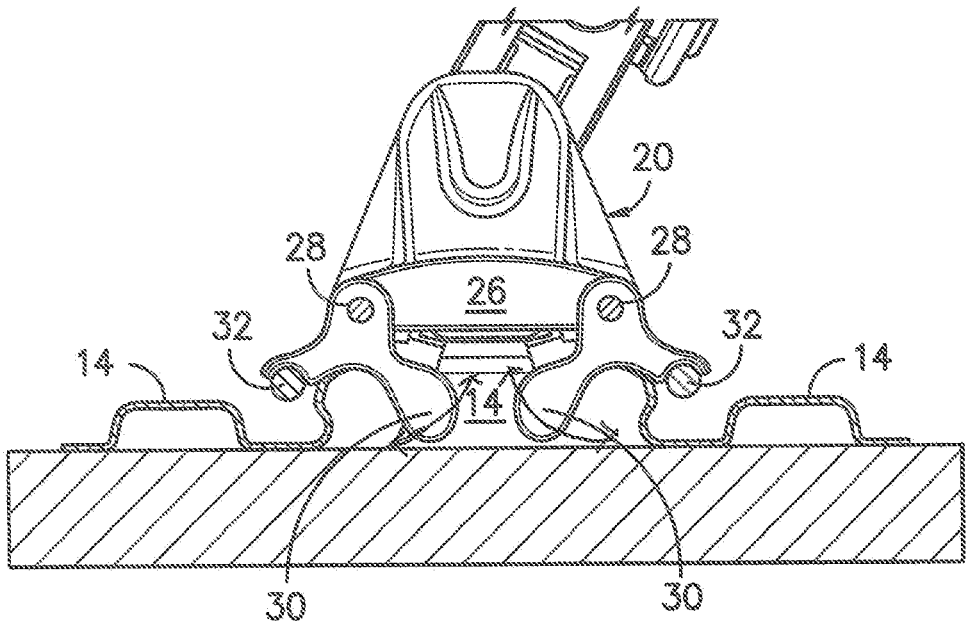
FIG. 3 is a side view illustrating the exemplary attachment frame of FIG. 2 with inboard arms in contact with an underlying mop head prior to articulating rotation.
Figure 4:
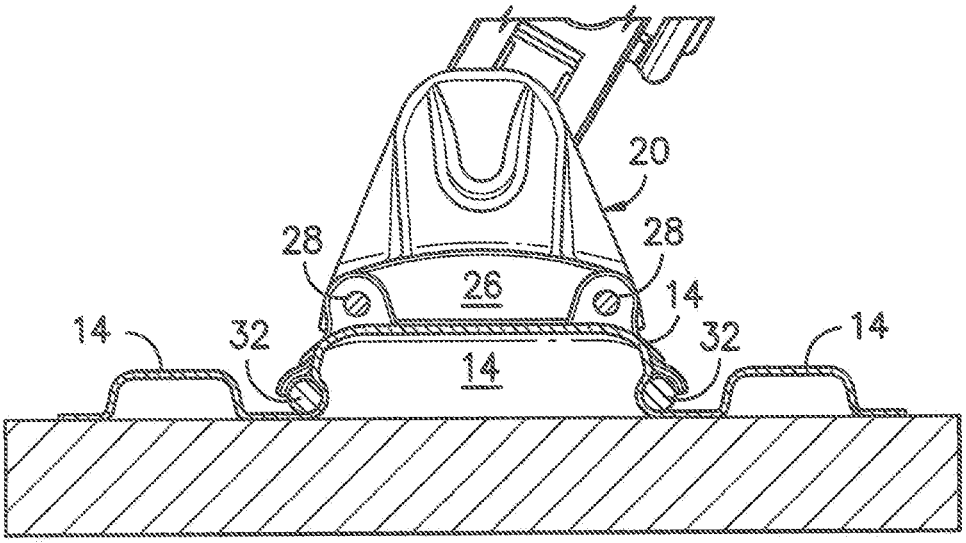
FIG. 4 is an interior cut-away view taken behind the articulating inboard arms of FIG. 3 illustrating the rail members in locked position after rotation.

Referring now jointly to FIGS. 3 and 4, when use is initiated, attachment frame 20 may be initially positioned by a user in contacting relation with backer plate 12 such that rail members 32 are in an elevated position (FIG. 3). As a user pushes downwardly through handle 24, inboard arms 30 rotate inwardly generally towards a centerline of mop head 10 in a camming action. In this regard, rotation may be facilitated by inboard arms 30 having lobed configurations defining camming surfaces to act against the underlying backer plate. However, other inboard arm configurations such as alternative curved or angular surfaces which urge inboard rotation in response to downward force may likewise be used if desired. It is also contemplated that backer plate 12 may be contoured at locations contacting inboard arms 30 to facilitate inward rotation either alone or in combination with complementary contoured arm surfaces.

Regardless of the configuration used, inward rotation of inboard arms 30 preferably causes inward rotation of to a degree that the arms 30 move past center while simultaneously rotating operatively connected rail members 32 downwardly and inwardly from an elevated position (FIG. 3) to a secured position against interior raised surface elements 14 (FIG. 4). In this regard, this secured position may cause rail members 32 to slightly compress the opposing raised surface elements 14. The raised surface elements 14 may include an outwardly projecting lip to promote retention of rail members 32. As illustrated in the various drawings, rail members 32 may be continuous structures extending beyond the ends of base 26 to facilitate an enhanced connection to backer plate 12. However, it is likewise contemplated that rail members 32 may also be segmented and extend along only selected portions of attachment frame 20. Moreover, while rail members 32 are illustrated as generally cylindrical with generally hemispherical or other uncovered curved exposed surfaces to press against raised surface elements 14, it is likewise contemplated that other geometries such as polygon cross section rods and the like with angular uncovered exposed surfaces may also be used if desired.

Figure 5:
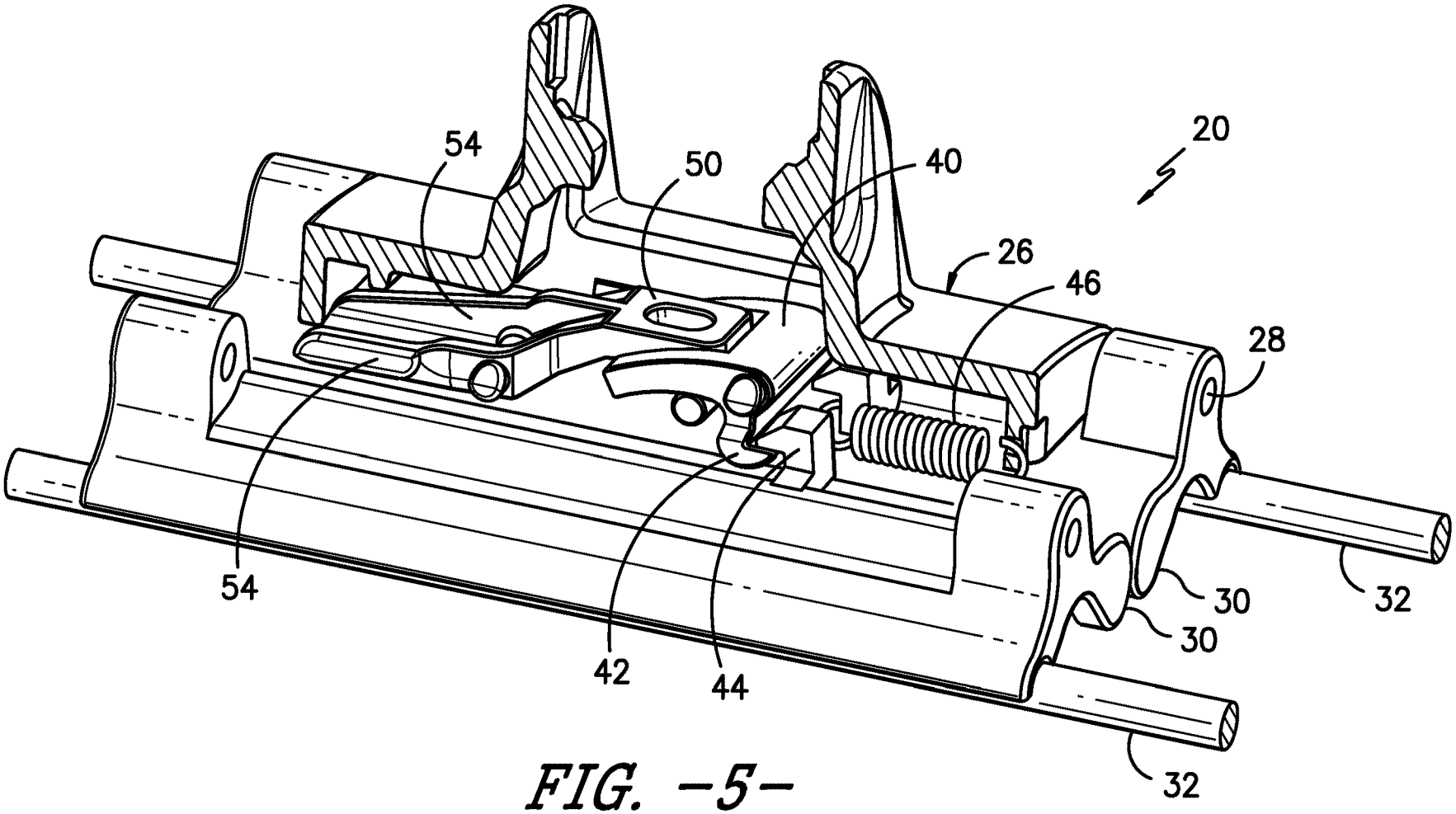
FIG. 5 is a perspective cut-away view of the exemplary attachment frame illustrating exemplary interior locking and release mechanism with articulating inboard arms and rail members rotated to inboard locked positions.

Referring now to FIG. 5, reverse outward rotation is preferably blocked during engagement such that attachment frame 20 and backer plate 12 are held together during use. By way of example only, and not limitation, in the illustrated exemplary construction, reverse rotation (and corresponding disengagement) may be blocked by a spring loaded latching mechanism engaged by the same downward force used to rotate inboard arms 30. As illustrated, in the exemplary construction a rocker 40 having a cradle 42 defining a locking bar is provided at the interior of base 26. One or more catch posts 44 are positioned in opposing relation to cradle 42. A spring member 46 may be used to bias cradle 42 generally towards catch posts 44.

In the illustrated exemplary construction, cradle 42 is normally positioned above catch posts 44 when attachment frame 20 is in the unlocked condition prior to inward rotation of inboard arms 30 and rail members 32. As downward pressure is applied through handle 24 and inboard arms 30 rotate inwardly, cradle 42 will also be pushed downwardly and snap beneath the nose portions of catch posts 44. In this regard, the underside of cradle 42 and the upper surface of catch posts 44 may have complementary curved and/or angled surfaces to facilitate sliding engagement as cradle 42 is pushed downwardly to the locked position. Once in the locked position (FIG. 5) spring member 46 is in tension thereby continuously biasing cradle 42 to the locked condition.

As shown, in the illustrated exemplary construction, a resilient lift release 50 may be positioned at the interior of base 26. Lift release 50 is preferably operably connected to a lever-actuated tensioning cable 52 (FIG. 2) which can be activated by a user. Lift release 50 is also operatively connected to rocker 40 and to spreading arms 54 used to apply downward force and rotate inboard arms 30 away from one another.

Figure 2:
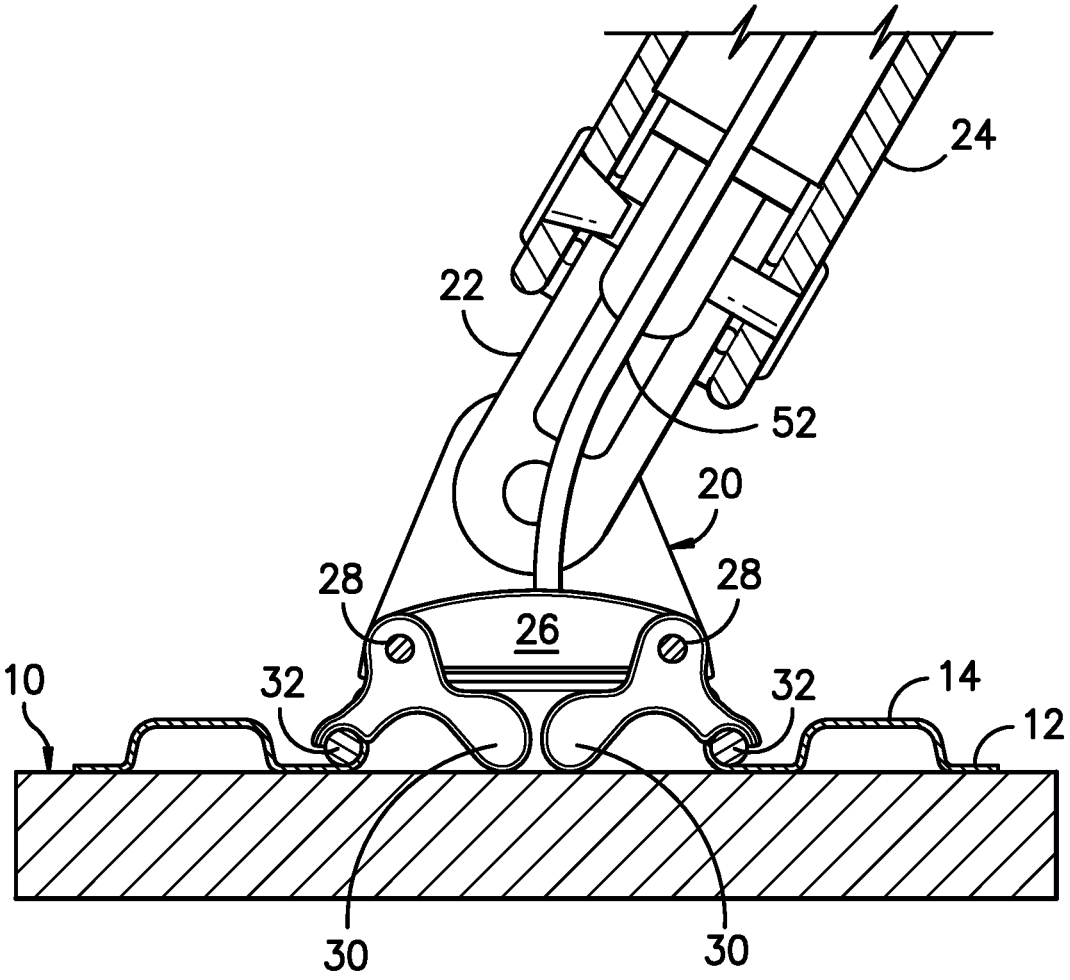
FIG. 2 is an enlarged partial cut-away side view corresponding to FIG. 1 illustrating an exemplary attachment frame in the engaged position relative to a mop head backer plate with inboard arms and rail members rotated inwardly to a locked position.

Referring now to FIGS. 1, 2 and 5, in accordance with one exemplary practice, handle 24 may include a depressible cover 56 in overlying relation to a spring-loaded lever 58 or the like operatively connected to tensioning cable 52. When cover 56 is depressed, lever 58 is rotated thereby causing tensioning cable 52 to be pulled upwardly. This upward movement is transferred through tensioning cable 52 to lift release 50 thereby raising lift release 50 away from the position shown in FIG. 5. In this regard, any suitable operative connection may be used between tensioning cable 52 and lift release 50.

As lift release 50 is raised, the operatively connected spreading arms 54 are pushed downwardly and rocker 40 is simultaneously caused to rotate and move cradle 42 downwardly and away from catch posts 44 thereby releasing the locked engagement. The downward force by spreading arms 54 reverses the prior rotation and releases rail members 32 from capture. In this released condition, mop head 10 is free to fall away from attachment frame 20 for placement into a trash receptacle, recycling bin or the like. By way of example only, rocker 40 may be simultaneously caused to rotate and move cradle 42 away from catch posts 44 by upward force applied by an underlying bar or other suitable structure which moves in conjunction with lift release 50 and engages a curved lower surface of rocker 40. Once the depressing force against lever 58 is removed, inboard arms 30 and rail members 32 will then remain in the spread condition until an adequate downward locking force is applied as described previously.

Of course, it is to be understood that other locking and release mechanisms may be used if desired. By way of example only and not limitation, such alternatives may include a wired or wireless signal or other suitable transmission arrangement that can be activated by a user from the handle in place of tensioning cable 52.

The present disclosure is subject to a wide array of alternatives. By way of example only, and not limitation, in accordance with one potential alternative, the force-induced inward camming action of inboard arms 30 may be reversed if desired such that rail members 32 are caused to move outwardly to lock in pressing relation against properly configured outboard raised surface elements rather than against the inboard raised elements. That is, inboard arms 30 may be configured with camming surfaces causing outward rotation when force is applied against an underlying surface, thereby causing operatively connected rail members 32 to rotate upwardly and outwardly for securement against surfaces of outboard raised elements configured with overhangs or other receiving features adapted to engage and retain exposed surfaces of the rail members.

It is to be understood that preferred embodiments of this disclosure are described herein, including the best mode known to the inventors for carrying out the disclosure. However, variations of those preferred embodiments may become apparent to those of ordinary skill in the art upon reading the foregoing description. Skilled artisans may employ such variations as appropriate, and the disclosure may be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The use of the terms "a" and "an" and "the" and similar referents in the context of describing the disclosure (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

What is claimed is:

1. A mop system adapted for hands-free release of a disposable mop head having a backer plate, the mop system comprising:

an attachment frame operatively connected to an elongated handle, the attachment frame comprising a base supporting at least a first pivoting arm and a second pivoting arm disposed on opposing sides of a length dimension centerline of the attachment frame, a first rail member and at least a second rail member, the first rail member and the second rail member being disposed with length dimensions adjacent opposing lateral sides of the base, wherein the first rail member is operatively connected to the first pivoting arm and the second rail member is operatively connected to the second pivoting arm such that rotation of the pivoting arms is translated to the rail members, wherein the first rail member and the second rail member are each disposed outboard of the pivoting arms and wherein one or more of the pivoting arms is adapted to act against a surface of the backer plate such that downward force against the backer plate by a user pushing downwardly through the handle causes rotation of said one or more of the pivoting arms and translation of operatively connected rail members to a pressed relation against raised surface elements on the backer plate wherein the attachment frame further comprises a locking mechanism adapted to hold the rail members in a pressed relation against raised surface elements on the backer plate, the locking mechanism comprising a spring-loaded rocker having a cradle adapted for capture beneath opposing catch posts upon downward force and a release mechanism adapted for remote activation by a user such that activation of the release mechanism forces reversal of pivoting arm rotation, wherein the release mechanism comprises a lift release operatively connected to spreading arms such that raising the lift release moves the cradle away from the catch posts and forces the spreading arms to act downwardly and reverse pivoting arm rotation.

2. The mop system as recited in claim 1, wherein the attachment frame is operatively connected in swiveling relation to the elongated handle.

3. The mop system as recited in claim 1, wherein at least one of the first rail member and the second rail member is substantially cylindrical having uncovered curved surfaces.

4. The mop system as recited in claim 1, wherein each of said first rail member and said second rail member is substantially cylindrical having uncovered curved surfaces.

5. The mop system as recited in claim 1, wherein the pivoting arms have a lobed construction.

6. The mop system as recited in claim 1, wherein the lift release is operatively connected to a tensioning cable extending between the release mechanism and a user activated lever on the handle remote from the attachment frame.

* * * * *